US011643759B2

(12) United States Patent
Bocchese

(10) Patent No.: US 11,643,759 B2
(45) Date of Patent: May 9, 2023

(54) ARTIFACT WITH KNITTED STRUCTURE AND METHOD OF REALIZATION THEREOF

(71) Applicant: MILES S.P.A., Vicenza (IT)

(72) Inventor: Michele Bocchese, Vicenza (IT)

(73) Assignee: MILES S.P.A., Vicenza (IT)

( * ) Notice: Subject to any disclaimer, the term of this patent is extended or adjusted under 35 U.S.C. 154(b) by 912 days.

(21) Appl. No.: 16/335,556

(22) PCT Filed: Jan. 17, 2018

(86) PCT No.: PCT/IB2018/050283
§ 371 (c)(1),
(2) Date: Mar. 21, 2019

(87) PCT Pub. No.: WO2018/134743
PCT Pub. Date: Jul. 26, 2018

(65) Prior Publication Data

US 2020/0018000 A1 Jan. 16, 2020

(30) Foreign Application Priority Data

Jan. 17, 2017 (IT) ..... 102017000004581

(51) Int. Cl.
*D04B 1/22* (2006.01)
*D04B 1/16* (2006.01)

(52) U.S. Cl.
CPC ..... *D04B 1/16* (2013.01); *D04B 1/22* (2013.01)

(58) Field of Classification Search
CPC ... D04B 1/16; D04B 1/22; D04B 1/14; D04B 1/24
See application file for complete search history.

(56) References Cited

U.S. PATENT DOCUMENTS 2,608,078 A 8/1952 Anderson
4,196,534 A * 4/1980 Shibamoto ..... D04B 1/16 66/170

(Continued)

FOREIGN PATENT DOCUMENTS

CN 101084333 12/2007
CN 101736478 6/2010

(Continued)

OTHER PUBLICATIONS

International Search Report and Written Opinion of the International Searching Authority for International Patent Application No. PCT/IB2018/050283 dated Apr. 5, 2018, 17 pages.

(Continued)

*Primary Examiner* — Danny Worrell
(74) *Attorney, Agent, or Firm* — Merchant & Gould P.C.

(57) ABSTRACT

A method of manufacturing an at least partially knitted artifact (4) includes knitting at least one multilayer fabric sheet (8) having at least a first layer (12) made with a first yarn (14), of animal, plant, synthetic and/or artificial origin, and at least a second layer (22), made with a second, heat-shrinking yarn (24). The first and second layers (12, 22) being at least partially interconnected in respective knitting stitches (28), during the knitting operation. The multilayer fabric sheet (8) is shaped according to a predefined shape.

(Continued)

The multilayer sheet (8) is subjected to heat treatment to obtain predefined shrinkage of the second heat-shrinking yarn (24) and a dimensional stabilization of the sheet. The second yarn (24) forms a bearing structure of the multi-layer sheet (8) and the multilayer sheet (8) is assembled to form the artefact (4) by stitching and/or gluing edges of the dimensionally stabilized sheet.

14 Claims, 7 Drawing Sheets

(56) References Cited

U.S. PATENT DOCUMENTS

| | | | | |
|---|---|---|---|---|
| 5,158,821 | A | 10/1992 | Gebauer et al. | |
| 5,215,807 | A | 6/1993 | Day et al. | |
| 5,855,124 | A * | 1/1999 | Donaghy | D04B 21/18 66/195 |
| 6,630,414 | B1 * | 10/2003 | Matsumoto | D04B 21/10 66/196 |
| 6,685,535 | B2 * | 2/2004 | Mitchell | D04B 1/246 450/75 |
| 7,614,256 | B2 * | 11/2009 | Mitchell | D04B 1/243 66/179 |
| 8,173,558 | B2 * | 5/2012 | Fukuoka | D04B 1/18 66/136 |
| 9,150,986 | B2 * | 10/2015 | Dua | D04B 1/24 |
| 11,001,947 | B2 * | 5/2021 | Amis | D04B 1/26 |
| 2017/0022640 | A1 * | 1/2017 | Schenk | D04B 1/22 |

FOREIGN PATENT DOCUMENTS

| | | |
|---|---|---|
| CN | 106087218 | 11/2016 |
| DE | 102005034798 | 11/2006 |
| DE | 10 2015 206 301 A1 | 10/2016 |
| EP | 0 336 507 A1 | 10/1989 |
| EP | 0 887 451 A2 | 12/1998 |
| EP | 1 055 757 A1 | 11/2000 |
| JP | 1991059153 | 3/1991 |
| JP | 1993068757 | 3/1993 |
| JP | 2016198495 | 12/2016 |

OTHER PUBLICATIONS

Search Report received in corresponding application in Italy dated Jun. 14, 2017, 14 pages.

Office Action Search Report received in corresponding application in Japan dated Feb. 1, 2022, 7 pages.

Office Action Search Report received in corresponding application in China dated May 19, 2020, 14 pages.

European Search Report received in corresponding application dated Jul. 1, 2021, 25 pages.

* cited by examiner

ARTIFACT WITH KNITTED STRUCTURE AND METHOD OF REALIZATION THEREOF

This application is a National Stage Application of PCT/IB2018/050283, filed 17 Jan. 2018, which claims the benefit of Ser. No. 102017000004581, filed 17 Jan. 2017 in Italy, and which applications are incorporated herein by reference. To the extent appropriate, a claim of priority is made to each of the above-disclosed applications.

SCOPE

The present invention relates to a method for producing a textile artifact, in particular a clothing accessory such as a bag, containing heat-shrinking yarn and the clothing accessory thereof.

STATE OF THE ART

As is known, in the field of textile artifacts and in particular clothing accessories, designers need to make objects that are always different and appealing to the public.

From an aesthetic point of view, the fabrics obtained with knitting machines offer various possibilities and aesthetic variations. The problem is that knitted fabrics do not have sufficient stiffness to be able to make a clothing element, such as a bag, that is free-standing. For this reason, the production of bags provided with knitted fabric portions has not been particularly widespread or has in many cases led to solutions which require a bearing structure which serves to support the portion of knitted fabric applied therein.

It is clear, however, that the provision of a support layer increases the thickness, weight and cost of the final artifact. Furthermore, the support layer needs to be finished and/ or coated to prevent it from being unpleasant to the touch and to avoiding that, being visible, it may compromise the overall appearance of the artifact.

PRESENTATION OF THE INVENTION

The need is therefore perceived to resolve the drawbacks and limitations cited with reference to the known art.

DESCRIPTION OF THE FIGURES

Further features and advantages of the present invention will become more understandable from the following description of its preferred and non-limiting embodiments, wherein.

Figure 1:
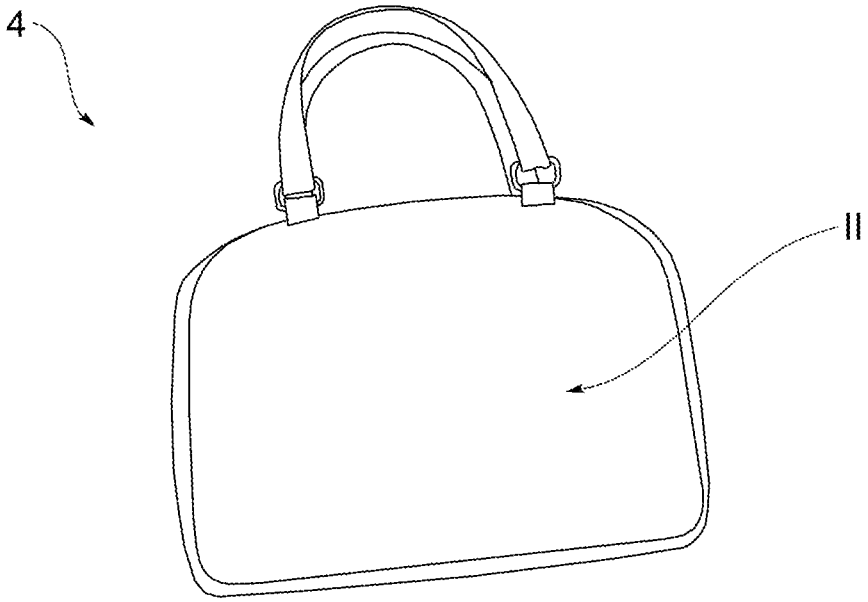
FIG. 1 is a schematic view of a clothing accessory, such as a bag, according to the present invention.

The elements or parts of elements in common between the embodiments described hereinafter will be indicated at the same numerical references.

DETAILED DESCRIPTION

With reference to the aforesaid figures, an overall schematic view of an artifact, such as a bag, a jacket, a sofa, a shoe, in accordance with the present invention is indicated collectively at 4.

For the purposes of the present invention, it should be specified that the term artifact must be considered in a broad sense, and not limited to the examples of bags, sofas, jackets and footwear (illustrated in the figures).

This means that while referring hereinafter to a bag, the present invention is to be considered as applicable to any type of artifact.

In particular, the artifact according to the invention is at least partially knitted.

This means that the artifact may be at least partially and also fully knitted as better described hereinafter.

It is understood that the present invention may provide for embodiments wherein the artifact comprises 20 both portions of a sheet, at least partially knitted, and portions of another material, for example, made of leather, hide, synthetic materials. It is possible that such portions in leather, hide, synthetic materials are applied peripherally to portions of knitted fabric and/or which are at least partially superimposed thereon. All these embodiments must be considered as included in the scope of protection of the present invention.

The method of realization comprises initially the step of weaving at least one multilayer fabric sheet 8 comprising at least a first layer 12 made with a first yarn 14 and at least a second layer 22, made with a second yarn 24.

The first layer 12 comprises a first knitting yarn 14, of animal and/or plant and/or synthetic and/or artificial origin. For example, but not exclusively, the first yarn may be a yarn made of cotton, wool and/or synthetic fibers.

The second layer 22 comprises, as a second yarn 24, a heat-shrinking yarn.

Heat-shrinking yarn means a yarn in a material which, once subjected to a certain heating, shrinks, or shortens, irreversibly.

The first and second layer 12,22 are at least partially interwoven in respective knitting stitches 28 during the weaving operation.

For the purposes of the present invention, the type of knitting stitch is irrelevant; it is, however, important that said layers 12,22 be interconnected with each other by the same weaving operation, in a plurality of knitting stitches 28.

Figure 5:
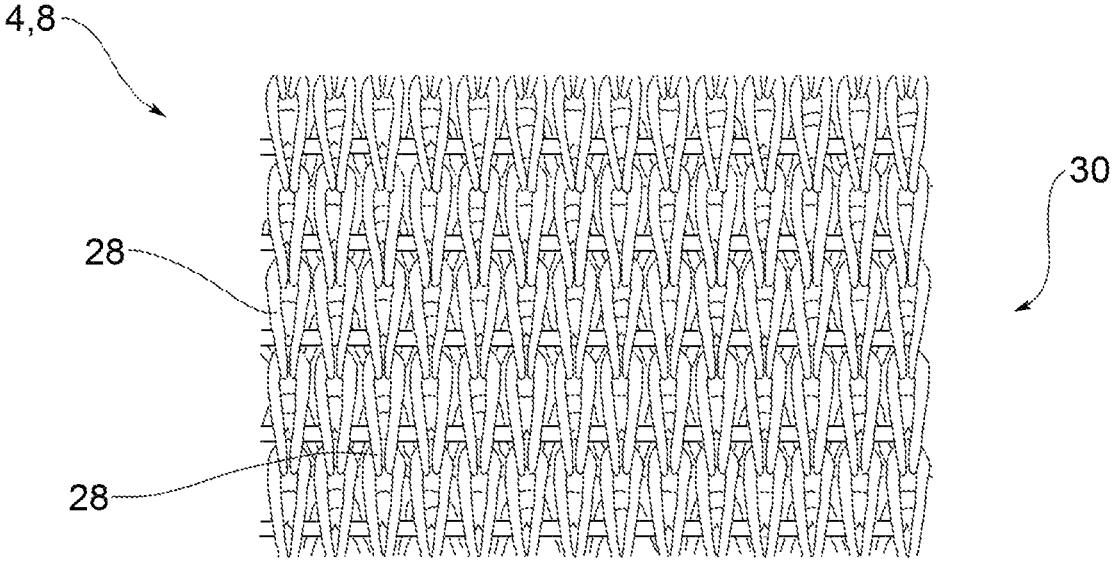
FIG. 5 shows a front view of an alternative embodiment of the enlarged detail II indicated in FIG. 1.
Figure 6:
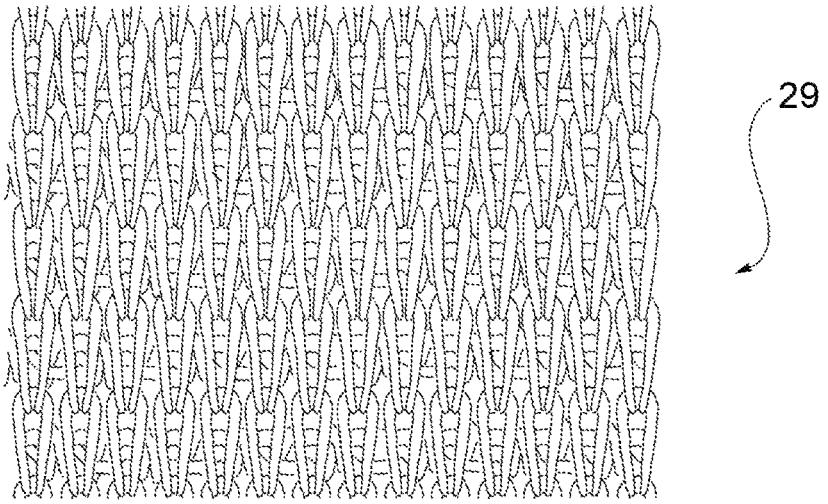
FIG. 6 shows a rear view of the detail of FIG. 5.
Figure 7:
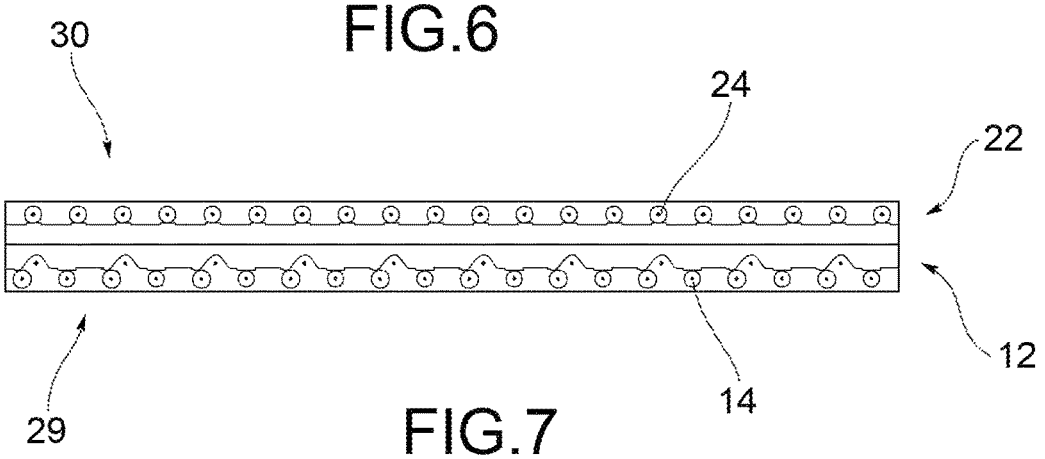
FIG. 7 shows a sectional view of the alternative embodiment of FIGS. 5-6, corresponding to the detail II indicated in FIG. 1.

It is possible to provide that the first layer 12 is arranged on the straight side 29, i.e. is visible on the outside, of the artifact 4, and that therefore the second layer 22 is arranged on the back side 30, not visible from the outside, of the same artifact artefact (FIGS. 5-7).

Figure 2:
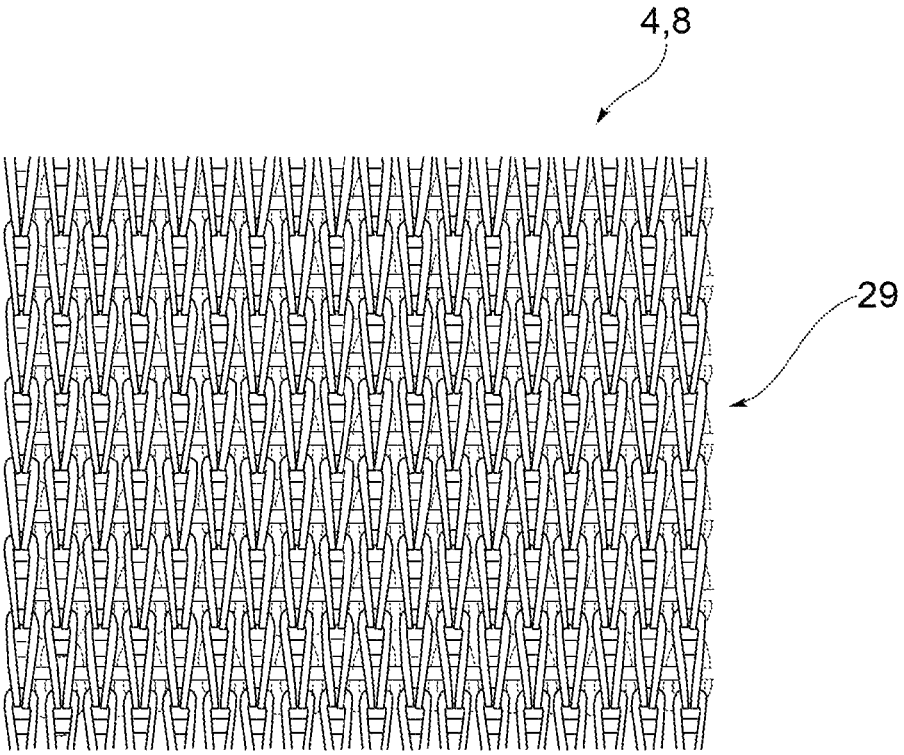
FIG. 2 is a front view of the enlarged detail II indicated in FIG. 1.
Figure 3:
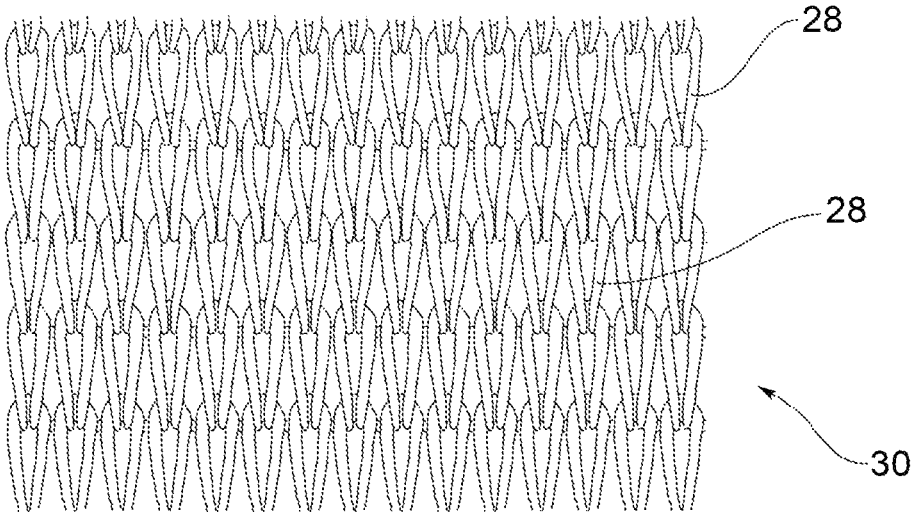
FIG. 3 shows a rear view of the detail of FIG. 2.
Figure 4:
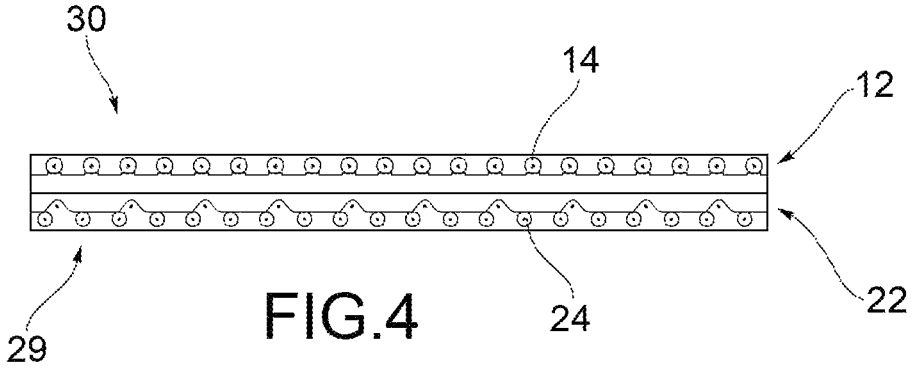
FIG. 4 shows a sectional view corresponding to the detail II indicated in FIG. 1.

It is also possible to provide that the second layer 22 is arranged on the straight side 29, i.e. visible on the outside, of the artifact 4, and that therefore the first layer 12 is arranged on the back side 30, not visible from the outside, of the same artifact artefact (FIGS. 2-4) .

It should be noted that the second heat-shrinking yarn 24 may be visible or not visible, also on the basis of the structure of the knit stitch used.

For example, the second yarn 24 may be visible on the front side or on the back side of the knitted multilayer sheet 8. When it is visible on the back side, the second layer 22, which realizes the load-bearing structure of the multilayer sheet, also acts as a knit stitch to create 3D effects, glossy and opaque effects or color contrasts. If it is visible on the back side, the second layer 22 may be seen behind it while the external part remains soft.

Figure 8:
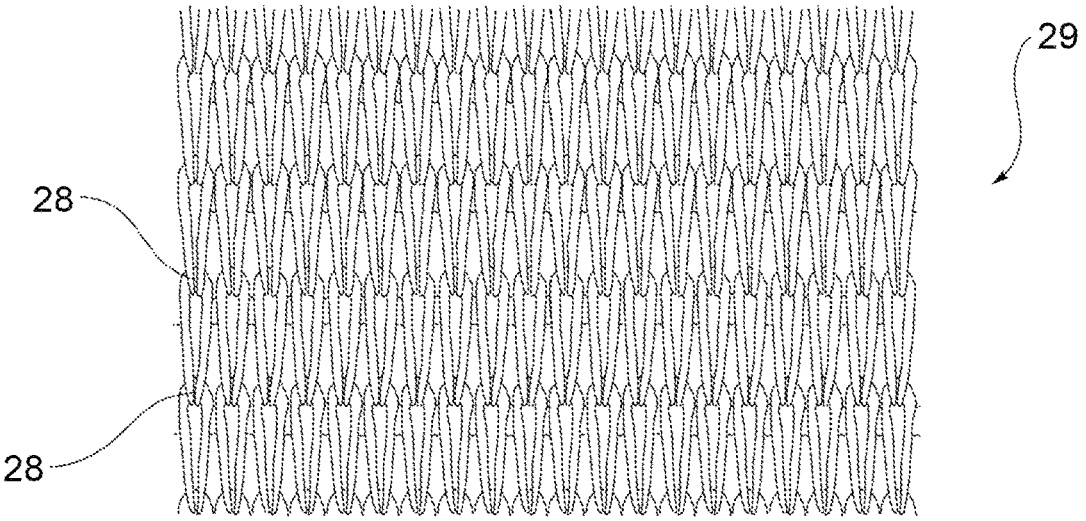
FIG. 8 shows a front view of a further alternative embodiment of the enlarged detail II indicated in FIG. 1.
Figure 9:
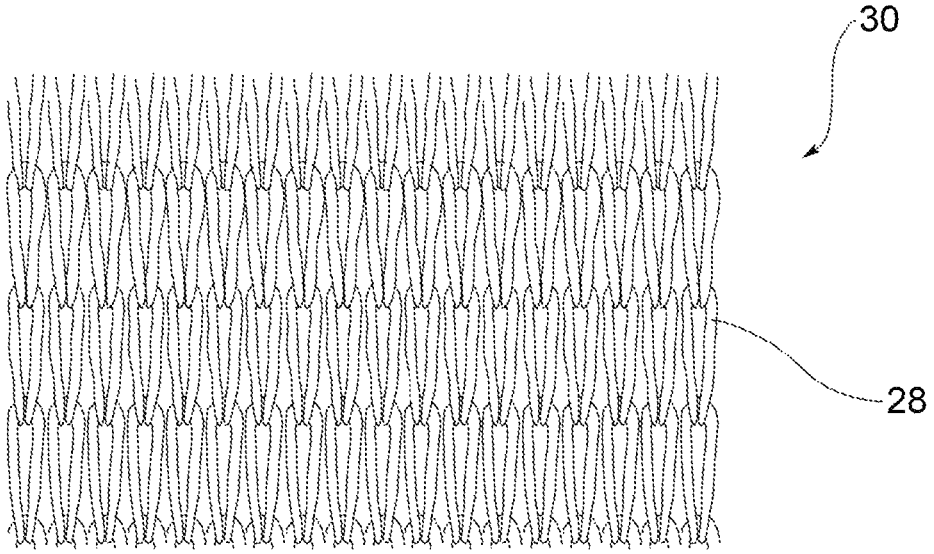
FIG. 9 shows a rear view of the detail of FIG. 8.
Figure 10:
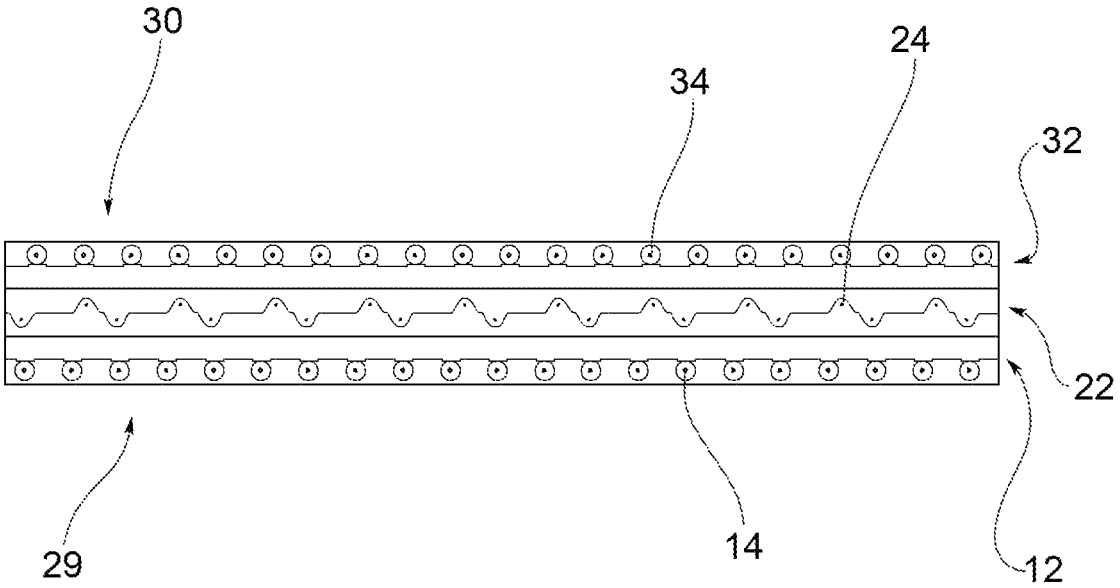
FIG. 10 shows a sectional view of the alternative embodiment of FIGS. 8-9, corresponding to the detail II indicated in FIG. 1.
Figure 11:
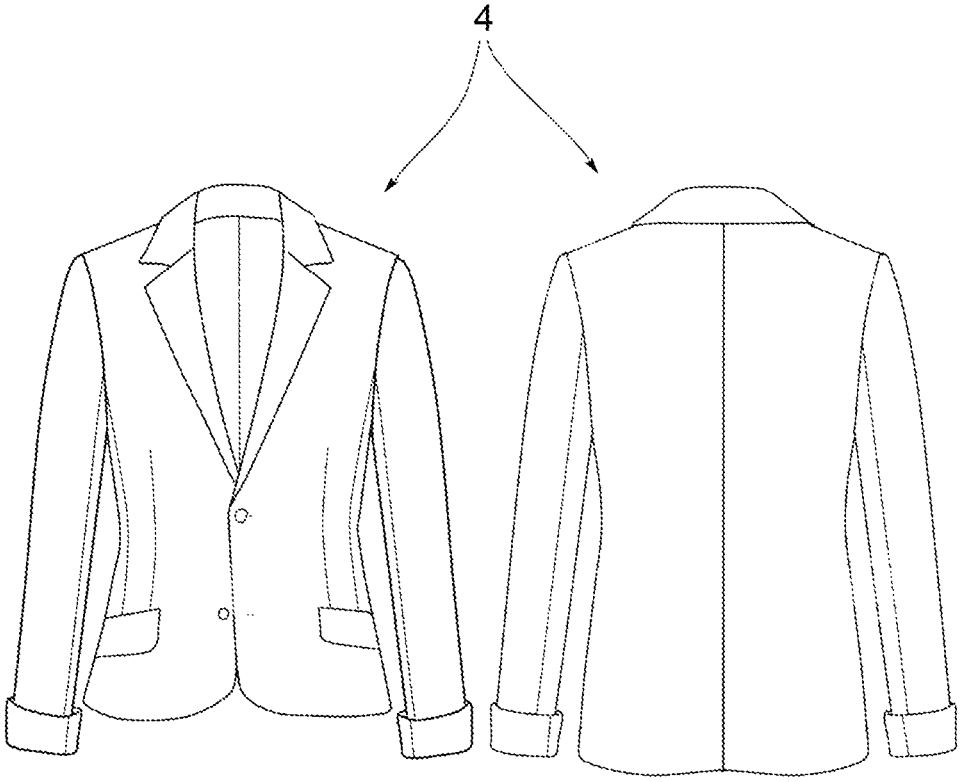
FIG. 11 shows two front and rear views of a jacket according to the present invention.
Figure 12:
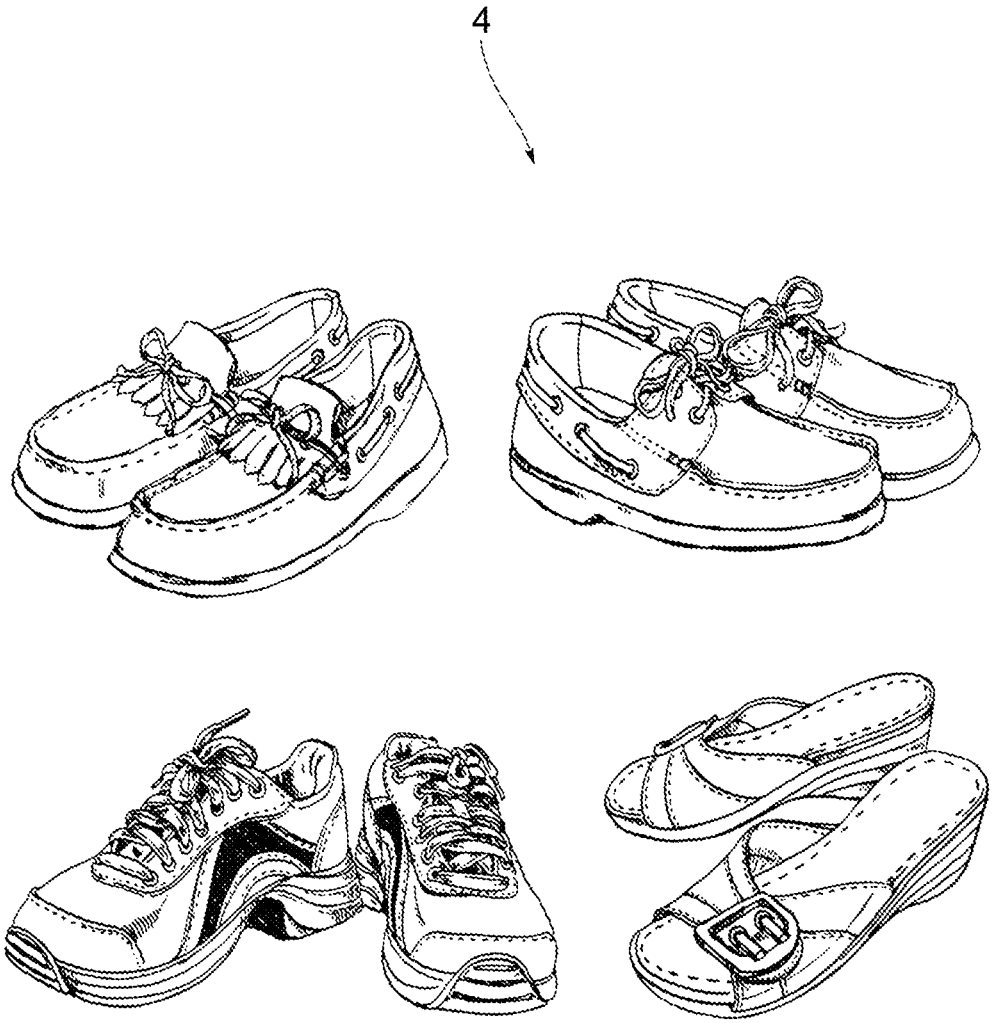
FIG. 12 is a partial perspective view of shoes according to an embodiment of the present invention.
Figure 13:
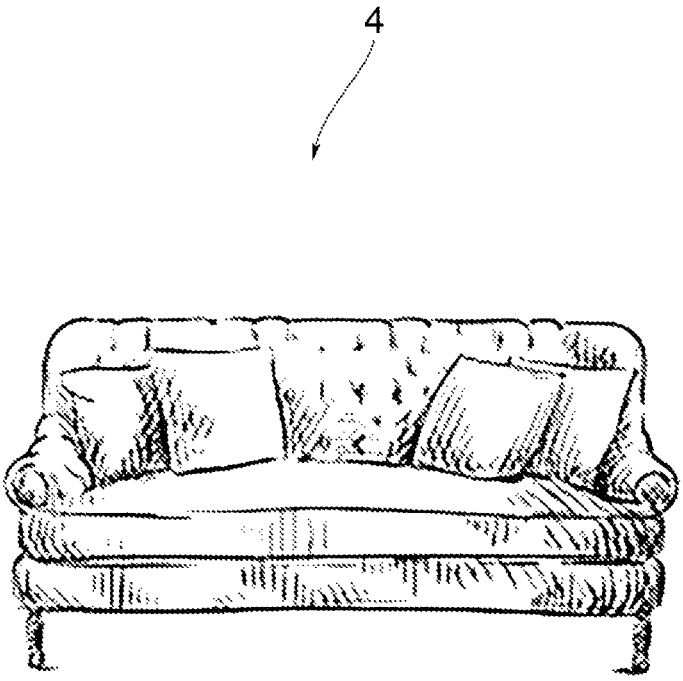
FIG. 13 is a front view of a sofa in accordance with the present invention.

According to a further embodiment of the present invention (FIG. 8-10), the step of weaving the multilayer fabric sheet 8 comprises the weaving of a third layer 32 made of a third knitting yarn 34 of animal and/or plant and/or synthetic and/or artificial origin, wherein the second layer 22 with the second heat-shrinking yarn 24 is placed between said first and third layers 12,22 and is interwoven with these in respective knitting stitches 28.

It should be noted that the multilayer sheet 8, regardless of the number of layers it comprises, is characterized in this step by the fact that the layers 12,22,32 are interconnected with each other in a plurality of knit stitches 28 and that the second layer in particular is bound to at least one further layer (whether the first layer 12, the third layer 32 or both) so as to be able to mechanically influence them following the subsequent heat treatment step, as better described hereinafter.

Advantageously, regardless of the overall number of layers of the multilayer sheet 8, the percentage of heat-shrinking yarn 24 inside the sheet 8 is between 35% and 66%.

According to a preferred embodiment, said percentage of heat-shrinking yarn inside the multilayer sheet 8 is equal to 55%.

According to one embodiment, the percentage by weight of heat-shrinking yarn 24 is less than ⅔ of the total weight of the multilayer sheet 8.

In general, the overall percentage of the second yarn 24 with respect to the multilayer sheet 8 depends on the mechanical softness/stiffness features to be obtained. It is clear that, by increasing the percentage of the second yarn 24, a greater stiffness of the multilayer sheet is obtained, to the detriment however of the tactile softness and also of its formability for realizing the artifact and also the adaptability of the artifact to a wearer, in the case of a clothing element.

Conversely, the reduction in the percentage of the second yarn 24 reduces the stiffness of the multilayer fabric 8 and facilitates its assembly and its wearability.

After obtaining the multilayer sheet 8, one proceeds with the shaping of at least one multilayer sheet 8 according to a predefined shape.

The predefined shape is dictated by the type of artifact to be made, and may be any shape, for the 20 purposes of the present invention.

Therefore, the step of stabilizing the multilayer sheet 8 is carried out through the step of subjecting the sheet 8 to a heat treatment to obtain a predetermined shrinkage of the heat-shrinking yarn and a dimensional stabilization of the sheet itself.

According to one embodiment, the dimensional stabilization of the multilayer sheet 8 comprises the steps of:

- subjecting the multilayer sheet 8 to a flow of steam to obtain a reduction in size of the multilayer sheet 8 between 30% and 40%,
- ironing the multilayer sheet 8 so as to fix the perimeter contours and to stabilize the sheet from a dimensional point of view.

Preferably, the heat treatment is a steam heat treatment, which comprises sending a flow of steam onto the multilayer sheet 8 and simultaneous pressing for a time of more than 60 seconds.

Preferably, said heat treatment involves sending a flow of steam onto the multilayer sheet 8 at a temperature ranging from 70° to 95° C.

Following this heating step, as seen, the second heat-shrinking yarn 22 shrinks between 40% and 60% of the original length; since this second yarn 22 is interconnected with the other layers 12,32 at the knitting stitches 28, such a significant shrinkage stiffens the multilayer sheet 8 considerably, which shrinks by tightening the knit at the knitting stitches 28.

In other words, the second layer 22 comprising the heat-shrinking yarn 24, once heat-shrunk, becomes rigid until a real bearing structure of the multilayer sheet 8 is obtained. Said bearing structure is closely connected to the other layer or layers 12,32 with which it is interconnected by means of the knitting stitches 28. In this way the second layer 22 realizes a load-bearing structure intrinsically anchored to the other layers of the multilayer sheet 8.

At this point it is necessary to definitively stabilize the shape and the size of the multilayer sheet 8.

The dimensional stabilization of the multilayer sheet 8 comprises therefore the steps of:

- shaping the multilayer sheet 8 while still warm after ironing, defining and/or finishing the edges,
- cooling the multilayer sheet 8 by removing the steam so as to definitively fix the shape and size.

In particular, after heating, the step of cooling the multilayer sheet 8 occurs by means of a flow of forced ventilation or suction air.

After the cooling step, the multilayer sheet 8 acquires the desired features of stability, consistency and stiffness and may be assembled.

After having finished the dimensional stabilization step of the multi layer sheet 8, one proceeds in effect with the assembly step the multi layer sheet 8, already dimensionally stabilized, to form the required artifact 4 by means of stitching and/or bonding the edges of the dimensionally stabilized sheet.

For example, in the case of a bag, a closed body may be obtained from said multilayer sheet 8 which is folded and sewn and/or glued.

As may be appreciated from the foregoing, the present invention overcomes the drawbacks of the prior art.

In particular, the present invention provides for a production, carried out with knitting machines, which incorporates a heat-shrinking yarn with a knitting stitch created from different knitting yarns.

This heat-shrinking yarn, as seen, creates a bearing structure that changes according to the chosen knitting stitch. The combined processing of these knitting yarns, together with the heat-shrinking yarn, allows the fabric to be locked, making it much stronger than a traditional knit fabric, and able to support the weight of an accessory, such as a bag, without having to resort to other supporting materials. Therefore, the drawback of the known solutions, which require the use of a specific bearing structure for the accessory, for example in leather, is resolved.

The heat-shrinking yarn may be visible or not visible, on the basis of the structure of the knit stitch used.

In the first case the structure may be visible on the front or back side of the knitted fabric. When the front side is visible, the bearing structure also acts as a knit stitch to create 3D effects, glossy and opaque effects or color contrasts. In this way, the possibilities for the stylist or designer to create aesthetic effects that are not present in known solutions are increased.

If the bearing structure is visible on the back side, the rigid part may be seen behind it while the external part remains soft. In this case, there will be two different layers.

On the other hand, when the bearing structure remains inside, it is not visible on the front nor on the back because it is completely covered by the other yarns. In this case there are therefore three different layers. On the outside and inside are the knitting yarns, while on the inside is the heat-shrinking yarn.

Thus, to sum up, the textile artifact, according to the present invention is provided with the necessary stiffness, so as to be free-standing, that is to say, self-supporting, without the need to use an inner support layer.

In this way the method of realization of the artifact is simplified, avoiding the need to resort to specific coatings of the bearing layer, both for aesthetic aspects and for comfort reasons, reducing the number of components and the total cost of the artifact.

From the technological point of view, the bag, or in general the accessory, is made simply by folding and stitching the single sheet on the sides, after the latter has undergone the stiffening process of the heat-shrinking yarn incorporated therein.

In addition, the weaving process may be carried out with different knitting stitches in the same sheet, thus allowing changes in production without having to sew different pieces: this entails a further advantage in terms of time and cost of realizing the finished product.

The weaving also allows shaping in some specific stitches to allow the parts to be joined without having to cut the sheet at any point: for example, it is possible to obtain a bag with only two side seams.

A person skilled in the art, in the object of satisfying contingent and specific requirements, may make numerous modifications and variations to the artifact and methods of realization described above, all of which are within the scope of the invention as defined by the following claims.

The invention claimed is:

1. Method of manufacturing an artefact artifact at least partially knitted, comprising the steps of:

knitting at least one multilayer fabric sheet comprising at least a first layer made with a first yarn and at least a second layer, made with a second yarn, wherein the first layer includes a first knitting yarn, wherein the second layer comprises a second heat-shrinking yarn, said first layer and said second layer being at least partially interconnected in respective knitting stitches, during the knitting operation, shaping the at least one multilayer fabric sheet according to a predefined shape, stabilizing dimensionally the multilayer fabric sheet by subjecting the multilayer sheet to a heat treatment to obtain a predefined shrinkage of the second heat-shrinking yarn and a dimensional stabilization of said sheet, the second yarn forming a bearing structure of the multi-layer sheet, assembling the multilayer sheet, already dimensionally stabilized, to form the artifact by stitching and/or gluing edges of the dimensionally stabilized sheet, wherein the dimensional stabilization of the multilayer sheet comprises:

subjecting the multilayer sheet to a flow of steam to obtain a reduction in size of the second heat-shrinking yarn between 30% and 40%, ironing the multilayer sheet to fix perimeter boundaries.

2. Method of making an artifact at least partially knitted according to claim 1, wherein the percentage by weight of second heat-shrinking yarn in the multilayer sheet is between 40% and 66%.

3. Method of making an artifact at least partially knitted according to claim 1, wherein the percentage by weight of second heat-shrinking yarn in the multilayer sheet is 55%.

4. Method of making an artifact at least partially knitted according to claim 1, wherein the percentage by weight of the second heat-shrinking yarn is less than ⅔of the total weight of the multilayer sheet.

5. Method of making an artifact at least partially knitted according to claim 1, wherein the dimensional stabilization of the multilayer sheet comprises the steps of:

shaping the multilayer sheet while still warm after ironing, defining and/or finishing the edges, cooling the multilayer sheet by removing the steam so as to definitively fix the shape and size.

6. Method of making an artifact at least partially knitted, comprising the steps of:

knitting at least one multilayer fabric sheet comprising at least a first layer made with a first yarn and at least a second layer, made with a second yarn, wherein the first layer includes a first knitting yarn, wherein the second layer comprises a second heat-shrinking yarn, said first layer and said second layer being at least partially interconnected in respective knitting stitches, during the knitting operation, shaping the at least one multilayer fabric sheet according to a predefined shape, stabilizing dimensionally the multilayer fabric sheet by subjecting the multilayer sheet to a heat treatment to obtain a predefined shrinkage of the second heat-shrinking yarn and a dimensional stabilization of said sheet, the second yarn forming a bearing structure of the multi-layer sheet, assembling the multilayer sheet, already dimensionally stabilized, to form the artifact by stitching and/or gluing edges of the dimensionally stabilized sheet, wherein the heat treatment is a steam heat treatment, which includes directing a flow of steam onto the multilayer sheet.

7. Method of making an artifact at least partly knitted according to claim 6, wherein simultaneous pressing is provided for more than 60 seconds.

8. Method of making an artifact at least partially knitted, comprising:

knitting at least one multilayer fabric sheet comprising at least a first layer made with a first yarn and at least a second layer, made with a second yarn, wherein the first layer includes a first knitting yarn, wherein the second layer comprises a second heat-shrinking yarn, said first layer and said second layer being at least partially interconnected in respective knitting stitches, during the knitting operation, shaping the at least one multilayer fabric sheet according to a predefined shape, stabilizing dimensionally the multilayer fabric sheet by subjecting the multilayer sheet to a heat treatment to obtain a predefined shrinkage of the second heat-shrinking yarn and a dimensional stabilization of said sheet, the second yarn forming a bearing structure of the multi-layer sheet, assembling the multilayer sheet, already dimensionally stabilized, to form the artifact by stitching and/or gluing edges of the dimensionally stabilized sheet, wherein the heat treatment provides for directing a flow of steam onto the multilayer sheet at a temperature between 70° C. and 95° C.

9. Method of making an artifact at least partially knitted, comprising the steps of:

knitting at least one multilayer fabric sheet comprising at least a first layer made with a first yarn and at least a second layer, made with a second yarn, wherein the first layer includes a first knitting yarn, wherein the second layer comprises a second heat-shrinking yarn, said first layer and said second layer being at least partially interconnected in respective knitting stitches, during the knitting operation, shaping the at least one multilayer fabric sheet according to a predefined shape, stabilizing dimensionally the multilayer fabric sheet by subjecting the multilayer sheet to a heat treatment to obtain a predefined shrinkage of the second heat-shrinking yarn and a dimensional stabilization of said sheet, the second yarn forming a bearing structure of the multi-layer sheet, assembling the multilayer sheet, already dimensionally stabilized, to form the artifact by stitching and/or gluing edges of the dimensionally stabilized sheet, wherein the step of heat treating the fabric provides, after heating, for a cooling step of the multilayer sheet by a flow of forced ventilation or suction air.

10. Method of making an artifact at least partially knitted according to claim 1, wherein the step of knitting the multilayer sheet of fabric comprises knitting of a third layer made of a third knitting yarn, wherein the second layer with the second heat-shrinking yarn is placed between said first and third layers and is knitted with said first and third layers in respective knitting stitches.

11. An artifact at least partially knitted made according to claim 1.

12. An artifact according to claim 11, wherein said artifact comprises a sofa, a jacket, a piece of clothing, or footwear.

13. An artifact according to claim 11, wherein said artifact is a bag.

14. Bag comprising a closed body obtained by a multilayer sheet according to claim 1, said multilayer sheet being folded and sewn and/or glued to form said closed body.

* * * * *